US006778152B1

(12) United States Patent
Huang

(10) Patent No.: US 6,778,152 B1
(45) Date of Patent: Aug. 17, 2004

(54) METHOD AND APPARATUS FOR DRIVING A PLASMA DISPLAY PANEL

(75) Inventor: Jih Fon Huang, Chu-Bei (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 09/388,041

(22) Filed: Sep. 1, 1999

(30) Foreign Application Priority Data

Feb. 9, 1998 (TW) ..... 87114581 A

(51) Int. Cl.[7] ..... G09G 3/28
(52) U.S. Cl. ..... 345/60; 315/169.3
(58) Field of Search ..... 345/60, 67, 68, 345/204, 55, 76, 89; 315/169.3, 169.1, 160

(56) References Cited

U.S. PATENT DOCUMENTS 5,420,602 A * 5/1995 Kanazawa ..... 345/67
5,436,634 A * 7/1995 Kanazawa ..... 345/67
5,952,986 A * 9/1999 Nguyen et al. ..... 345/68
5,959,619 A * 9/1999 Kameyama et al. ..... 345/204
6,169,527 B1 * 1/2001 Kanazawa et al. ..... 345/60
6,172,465 B1 * 1/2001 Huang ..... 315/169.3
6,252,574 B1 * 6/2001 Hosoi et al. ..... 345/103
6,441,561 B1 * 8/2002 Tsai ..... 315/169.1
2002/0167381 A1 * 11/2002 Ide et al. ..... 335/60
2002/0175631 A1 * 11/2002 Kim ..... 315/169.1
2003/0058194 A1 * 3/2003 Kang ..... 345/63
2003/0122740 A1 * 7/2003 Lee et al. ..... 345/60
2003/0222863 A1 * 12/2003 Yun et al. ..... 345/204
2004/0021653 A1 * 2/2004 Kim et al. ..... 345/204

* cited by examiner

*Primary Examiner*—Richard Hjerpe
*Assistant Examiner*—Ronald Laneau
(74) *Attorney, Agent, or Firm*—Ladas & Parry

(57) ABSTRACT

The present invention describes a method and apparatus of driving a plasma display panel that can reduce dynamic contour. The plasma display panel includes a plurality of scanning lines (for example, 600 scanning lines) Further, a subframe is completed by the three successive steps of resetting, scanning, and sustaining of scanning lines. Moreover, a full frame picture includes a plurality of subframes (for example, eight subframes in a gray plasma display panel with 256 colors). Each subframe sustains according to a predetermined ratio to obtain a plurality of colors. The present invention characterized by: first, dividing the scanning lines into a plurality of groups. Then, sustaining each group of subframes according to a different order in a full frame picture.

2 Claims, 5 Drawing Sheets

METHOD AND APPARATUS FOR DRIVING A PLASMA DISPLAY PANEL

BACKGROUND OF THE INVENTION

1. Field of the Invention

The present invention relates to a method and an apparatus for driving a plasma display panel (PDP). More particularly, it relates to a plasma display panel driver that reduces the occurrence of a dynamic false contour by dividing scanning lines into two or more groups and sustaining according to different ratios.

2. Description of the Related Art

Referring to FIG. 1, where a schematic diagram of the conventional methods of driving a plasma display panel is shown, a frame-display operation is composed of a plurality of subframe-display operations. For example, one frame picture in a plasma monitor with 256 gray levels includes eight subframes SF0~SF7 as shown in FIG. 1. Each subframe-display operation is completed by the following three steps of resetting, scanning, and sustaining. In a full frame-display operation, the working periods of the reset operation and the scan operation in the subframe-display operation are the same. In the case of 256 gray levels, the ratio of the working periods of the eight sustain steps can be assigned to 1:2:4:8:16:32:64:128:256. Thus, the plasma display panel is driven and shows 256 gray levels.

In a plasma display panel with 256 gray levels, the working period of the sustain operation is in proportion to the brightness level of the plasma display panel. Accordingly, when eight bits represent each pixel in the plasma display panel, the eight working periods of the sustain operation in a frame-display operation correspond to the eight bits, respectively. The longest working period of the sustain operation corresponds to the highest bit, and the shortest working period of the sustain operation corresponds to the lowest bit. As described above, the ratio of the working periods of the eight sustain operations can be assigned to 1:2:4:8:16:32:64:128. That is the working periods of the sustain operation correspond to the eight bits of a pixel, respectively. In order to adjust the brightness level of the plasma monitor and improve the effect for displaying, the working period of the sustain operation can be set to other ratios.

However, there can exist continuous colors in an area when one frame picture switches to another frame picture. That is, the color level and the brightness level of a first frame picture displaying before may he close to that of a subsequently displayed frame picture. Therefore, there might be a dynamic false contour in the plasma display panel. Further, tho area displaying the dynamic false contour might display an uncommon continuous dark area or an uncommon light area. For example, in a frame-display operation of a plasma display panel with 256 gray levels, the ratio of the working periods of the eight sustain operations are assigned to 1:2:4:8:16:32:64:128. It is supposed that a pixel is represented by eight bits. When the analog value of the eight bits is below and close to 127, the pixel is mainly sustaining and producing brightness in the prior seven subframe-operations. When the analog value of the eight bits is above and close to 128, the pixel is sustaining and producing brightness in the eighth subframe-operation. As colors with continuity probably exist in an area (or a block) when one frame picture switches to the other frame picture, a serious dynamic false contour may occur. For example, the analog value representing the intensity of colors and the brightness of a block A is below 127(and close to 127), while the analog value representing the intensity of colors and the brightness of a block B is above 128 (and close to 128) When the block A switches to the block B, an uncommon dark area is shown. Conversely, when the block B switches to the block A, an uncommon light area is shown.

FIG. 2A schematically shows the conditions when the block A switches to the block B, while FIG. 2B schematically shows the conditions when the block B switches to the block A. In FIG. 2A and FIG. 2B, the horizontal coordinate represents the period of time passed, i.e. the frame (n), frame (n+1), frame (n+2) . . . . Further, the white block represents block A and the block with cross lines represents the block B. Referring to FIG. 2A, where the analog value representing the intensity of colors and the brightness of a block switches from 127 to 128 is shown. Because eight dark subframes continuously appear in the frame picture, the dynamic false contour is caused. Also, FIG. 2B shows the analog value representing the intensities of colors and the brightness of a block switches from 128 to 121. Because eight light subframes continuously display, the dynamic false contour appears.

Accordingly, in order to reduce the dynamic false contour, some methods have been developed. For example, the times those dynamic false contours occur are counted. Based on this, the ratios or orders of sustaining in the eight subframes are amended. However, the method is effective on specific frame pictures. In other words, it is no use on other frame pictures.

SUMMARY OF THE INVENTION

In order to solve the problems described above, the primary object of the invention is to provide a method and an apparatus of driving of a plasma display panel reducing the dynamic false contour, wherein the plasma display panel is composed of a plurality of scanning lines, and a subframe is completed by three steps of resetting, scanning and sustaining, while a full frame picture is composed of a plurality of subframe-display operations, wherein the subframe-display operations in the full frame picture sustains according to a predetermined ratio so that a plurality of gray levels are obtained.

According to a second embodiment of the method of the present invention, the scanning lines are divided into a plurality of groups, and the subframe-display operations of groups of scanning lines sustain according to the predetermined ratio with different orders in the full frame picture. If, example, the full frame picture is composed of eight subframes-display operations to obtain 256 gray levels, the subframe-display operations of the first group sustain according to an order of 1:2:4:8:16:32:64:128 in the full frame picture, and the subframe-display operations of the second group sustain according to an order of 128:64:32:16:8:4:2:1 in the full frame picture.

Furthermore, the present invention provides a driving circuit of a plasma display panel to reduce dynamic false contour. The scanning lines of the plasma display panel are divided into a first group and a second group. In addition, the scanning lines have respectively a scanning electrode and a sustaining electrode. The driving circuit includes a data driver, a first scan driver, a second scan driver, a first sustaining driver, a second sustaining driver, and a timing controller. The data driver is used to receive the data displayed on the plasma display panel. The first scan driver is used to read the data displayed on the plasma display panel, and outputs tho data of the first group to the scanning electrode of the first group according to a first order or ratio. The second scan driver is used to read the data displayed on the plasma display panel, and outputs the data of the second group to the scanning electrode of the second group according to a second order or ratio. The first sustaining driver connects to sustaining electrodes of the first group, while the second sustaining driver connects to sustaining electrodes of the second group. In addition, the timing controller controls the timing of the first scan driver, the second scan driver, the first sustaining driver, and the second sustaining driver to drive the plasma display panel.

BRIEF DESCRIPTION OF THE DRAWINGS

These and other features of the present invention will now be described in detail with reference to the accompany drawings, in which.

DETAILED DESCRIPTION OF THE PREFERRED EMBODIMENT

Figure 1:
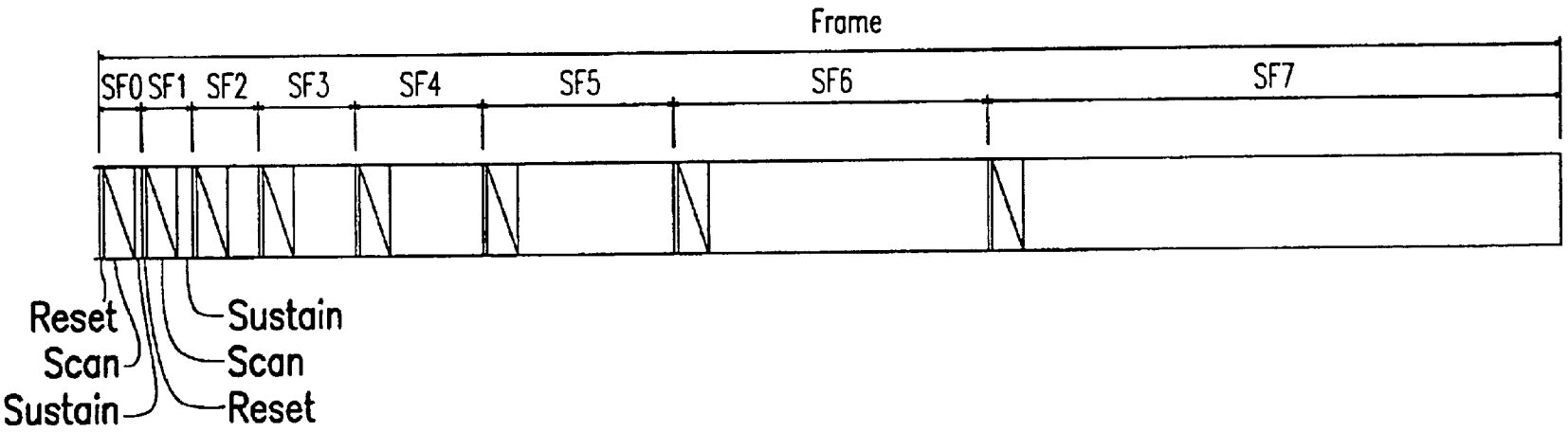
FIG. 1 (PRIOR ART)
FIG. 1 schematically shows the conventional method of driving a plasma display panel, FIG. 2A and FIG. 2B schematically show the dynamic false contour of a plasma display panel.
Figure 2A:
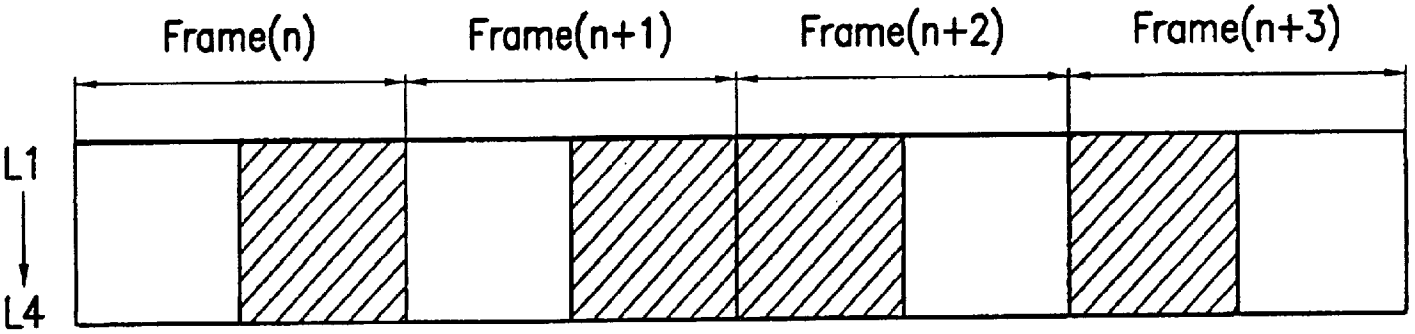
FIG. 2A (PRIOR ART)
Figure 2B:
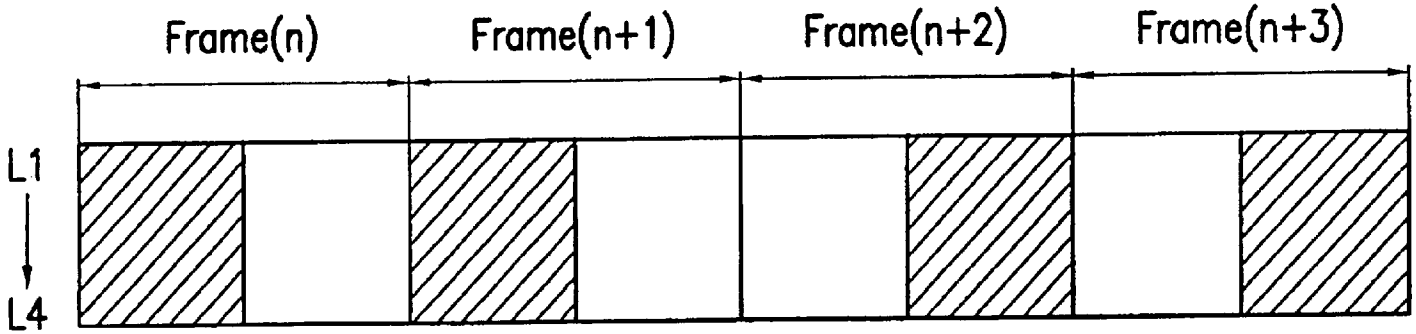
FIG. 2B (PRIOR ART)

The method of the personal invention is characterized by dividing the horizontal scanning lines of a plasma display panel into two or more groups which have different orders of the subframe sustain operations. Thus, the dynamic false contour in frame pictures is reduced.

The method of driving a plasma display panel is now described in detail.

First, a plasma display panel is provided. For example, the plasma display can have 256 gray levels and a resolution of 600×800. Each frame-display operation is composed of eight subframe-display operations. The working period of the sustain operation in each subframe-display operation is controlled by the input voltages of the scanning electrode and the sustaining electrode. In turn, the cumulative working period of the sustaining operations of the eight subframes determines the gray level of the corresponding pixel in corresponding frame.

In a preferred embodiment of the method of the present invention, the scanning lines are divided into two groups. However, it is to be noted that the scanning lines can also be divided into three or more groups. For convenience, this embodiment only takes the two groups (group 1 and group 2) as an example. One group includes odd scanning lines: L1, L3, . . . , L599 (group 1), and the other group includes even scanning lines: L2, L4, . . . , L600 (group 2).

The two divided groups of scanning lines are driven by two sustaining operations which have different working period order from subframe one to subframe eight. Note, the less coherence between the orders, the less dynamic false contour occurs. For example, the working period of the sustaining operation for group 1 eight subframes preferably has the ratio of 1:2:4:8:16:32:64:128 (ordered from subframe one to subframe eight); while that for group 2 preferably has same ratio, but with opposite order of 128:64:32:16:8:4:2:1. It is understood, however, that the above order of the working periods of the sustaining operations can he easily modified to any other order.

Let's take the above example to clearly describe how the embodiment can solve the problem. The plasma display panel has 256 gray levels and a resolution of 600×800. The working periods of sustaining operations of each subframes for group 1 and group 2 are defined as: 1:2:4:8:16:32:64:128 and 128:61:32:16:8:4:2:1 respectively.

When the eight-bit analog value of a pixel A is less than and close to 127: if pixel A is included in group 1, then it is mainly sustaining and producing brightness in the first seven subframes; if pixel A is included in group 2, then it is sustaining and producing brightness in the last seven subframes.

When the eight-bit analog value of a pixel A is more than and close to 128: if pixel A is included in group 1, then it is mainly sustaining and producing brightness in the eighth subframe; if pixel. A is included in group 2, then it is sustaining and producing brightness in the first subframe. In this embodiment, because the dark subframe and the light subframe between different groups of scanning lines are alternately presented, the dynamic false contour effect can be reduced.

Figure 4A:
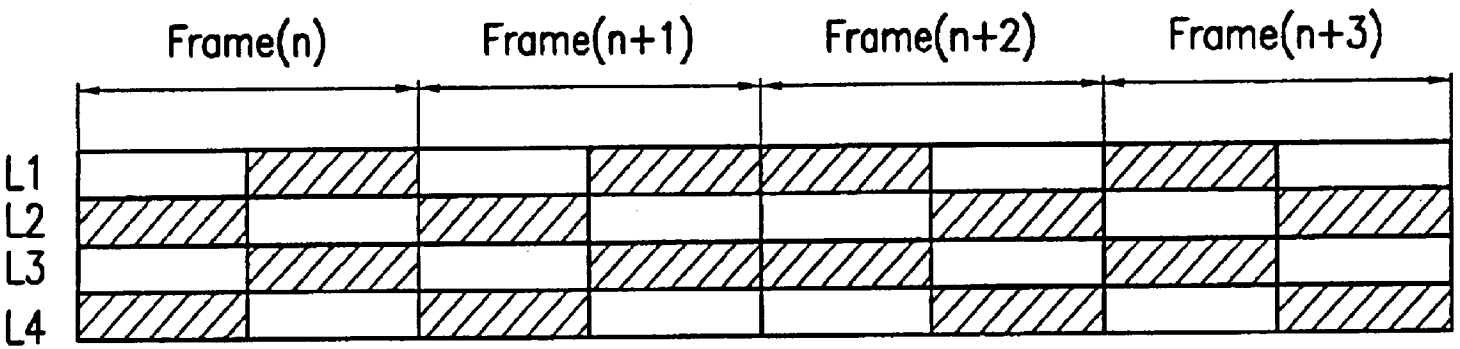
Figure 4B:
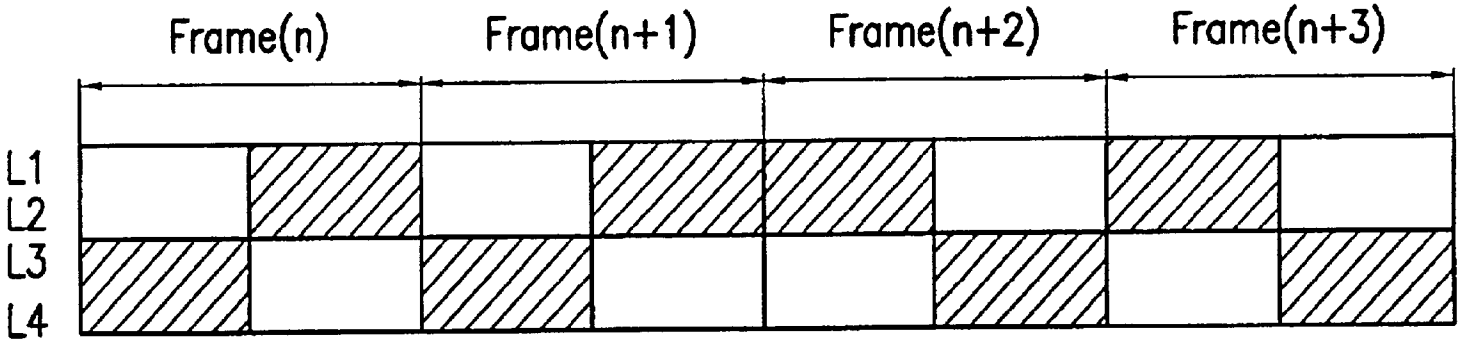

For example, FIG. 4A and FIG. 4B show the situation where the pixels with an eight-bit analog value switching from 127 to 128 between frame (n+1) and frame (n+2), so that the eight consecutive dark and light subframes occur in L1 and L2 respectively. FIG. 4A shows the situation where the scanning lines are divided into group 1 as: L1, L3, L5 . . . L599, and group 2 as: L2, L4, L6 . . . L600. FIG. 4B shows the situation where the scanning lines are divided into an alternated group 1 as: L1, L2, L5, L6 . . . , and group 2 as: L3, L4, L7, L8 . . . in FIG. 4A and FIG. 4B, the horizontal axis represents the timing order of the cumulative sustaining time period of consecutive frames. There are 256 sustain time levels in one frame column corresponding to 256 gray levels.

As shown in FIG. 4A, the analog values of the pixels in frame(n) and frame(n+1) are all 127. The pixels in L1 and L3 are sustaining and producing brightness in the first seven subframes (white block for the first halt of one cumulative sustaining time period, but cross-line book for the second half). The pixels in L2 and L4 are sustaining and producing brightness in the last seven subframes (white block for the second half of one cumulative sustaining time period, but cross-line block for the first half).

After the analog values of the pixels having switched from 127 to 128 between frame(n+1) and frame(n+2), the pixels in L1 and L3 are sustaining and producing brightness in the eighth subframe (white block for the second half of one cumulative sustaining time period, but cross-line block for the first half) The pixels in L2 and L4 are sustaining and producing brightness in the first subframe (while block for the first half of one cumulative sustain time period, but cross-line block for the second half).

The scanning lines are driven by two different orders of working period of the sustain operations to make the dark subframe and light subframe interchanged between different groups of scanning lines. It allows only eight consecutive dark subframes occur at one scanning line; but it can avoid the situation that eight consecutive dark subframes occur simultaneously at two neighboring scanning lines so that the dynamic false contour is reduced.

Comparing this result to FIG. 4B, FIG. 4B allows eight consecutive dark subframes simultaneously occur at two neighboring scanning lines; but it can avoid the situation that eight consecutive dark subframes occur simultaneously at four neighboring scanning lines. It is apparent, that the result of reducing the dynamic false contour in FIG. 4A is better than that in FIG. 4B.

Figure 4C:
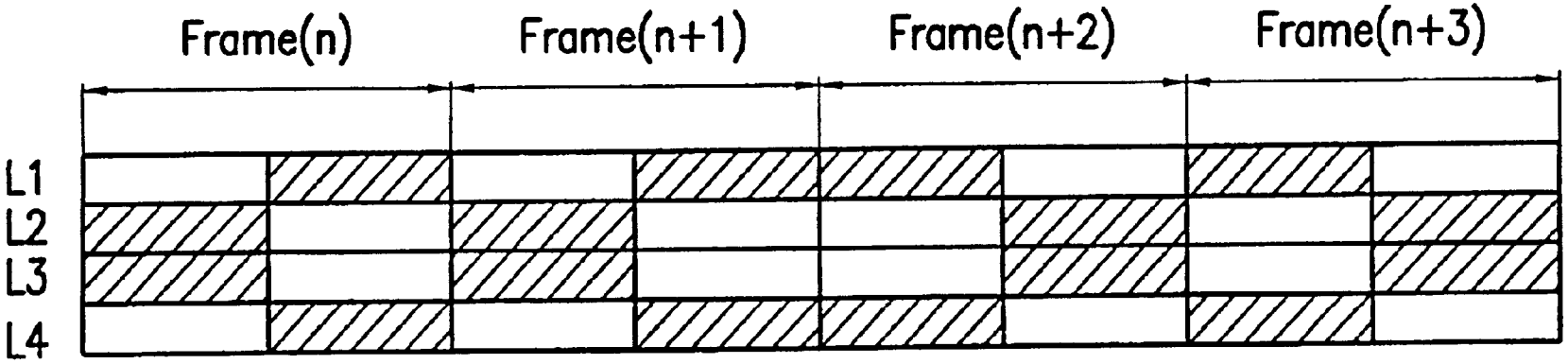

In addition, FIG. 4C shows another method of separating the scanning lines into two group 1 as: L1, L4, L5, L8, . . . and group 2 as: L2, L3, L6, L7, . . . . This result is also inferior to FIG. 4A.

Figure 3:
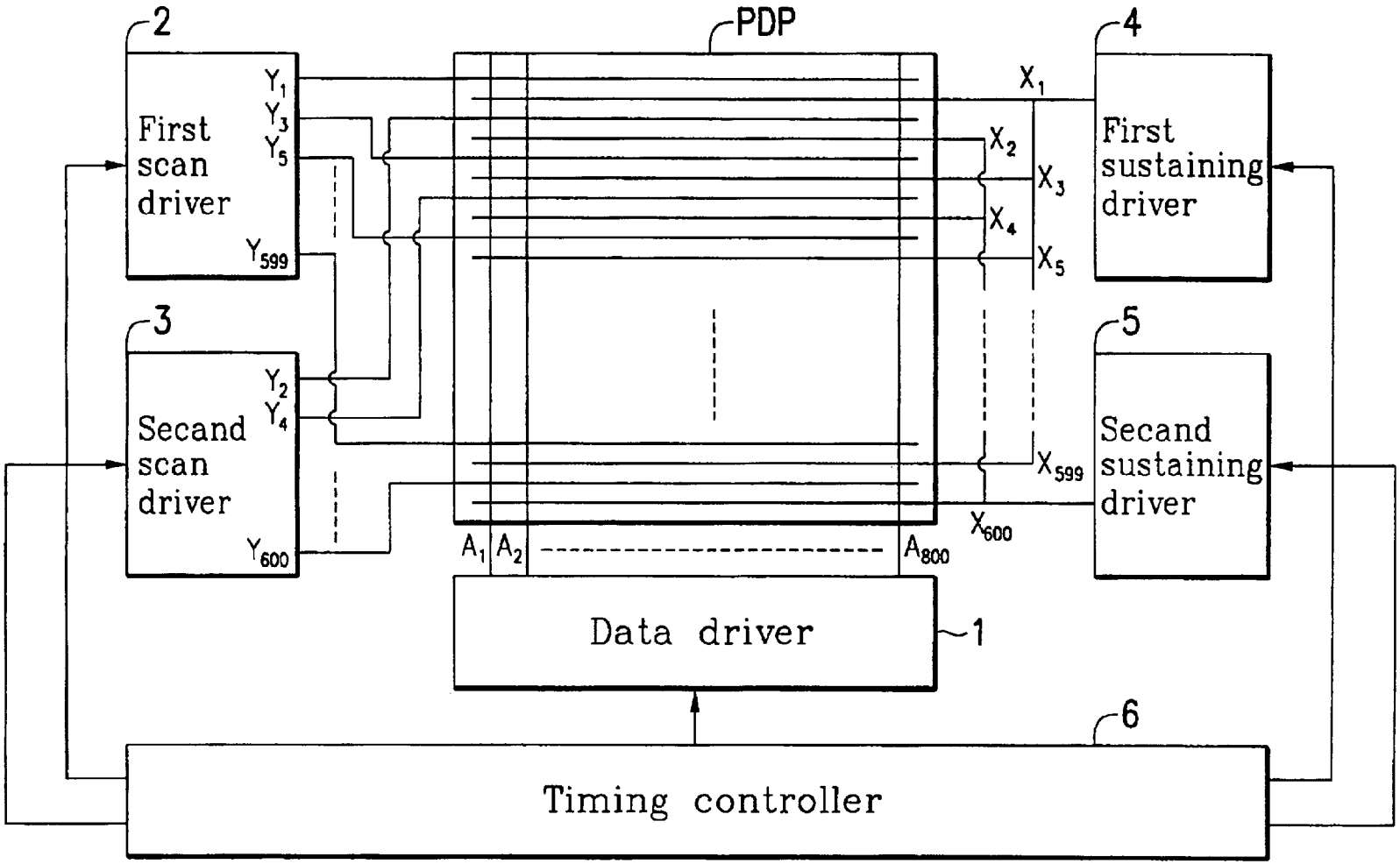
FIG. 3 shows a driving circuit of a plasma display panel according to the present invention, and FIG. 4A to FIG. 4C schematically show the dynamic, false contour or a plasma display contour of embodiments according to the present invention.

Referring to FIG. 3, a driving circuit of a plasma display panel according to the invention is shown. It is known that the plasma display panel comprises a plurality of scanning lines. (for example, L1~L600). In this embodiment, the scanning lines are divided into group 1 and group 2, though it is understood that the scanning lines could also be divided into three or more groups. Further, the scanning and sustaining operations are respectively controlled by the input voltage of the scanning electrodes Y1~Y600 and the sustaining electrodes X1~X600. The driving circuit includes the following devices: a data driver 1, a first scan driver 2, a second scan driver 3, a first sustaining driver 4, a second sustaining driver 5, and a timing controller 6, wherein the data driver 1 connects the address locating electrode (A1~A800) of the plasma display panel; the first scan driver 2 connects the first scanning electrode (Y1, Y3, . . . Y599) of the plasma display panel; the second scan driver 3 connects the second scanning electrode (Y2, Y4, . . . Y600) of the plasma display panel; the first sustaining driver 4 connects the first sustaining electrode (X1, X3, . . . X599) of the group 1; and the second sustaining driver 5 connects the second sustaining electrode (X2, X4, . . . X600) of the group 2. Additionally, in order to do the operations of resetting, scanning, and sustaining subsequently, the data driver 1, the first scan driver 2, the second scan driver 3, the first sustaining driver 4, the second sustaining driver 5 are controlled by the timing controller 6.

As described above, the driving method of the invention is completed by dividing the scanning lines into a plurality of groups. Additionally, the ratios of working periods of the sustaining operations are different or the orders are changed between the two groups. Thus, the dynamic false contour can be reduced.

While the present invention has described and illustrated herein with reference to the preferred embodiment thereof, it will be understood by those skilled in the art that various changes in the form and details may be made therein without departing from the spirit and the scope of the invention.

What is claimed is:

1. A driver of a plasma display panel, wherein the plasma display panel is composed of a plurality of scanning lines configured in a sequence as L1, L2, L3, L4, L5, L6, L7, L8 . . . , and the scanning lines are divided into a first group (L1, L2, L5, L6 . . . ) and a second group (L3, L4, L7, L8 . . . ), each scanning line (Ln, wherein n is an integer) has a scanning electrode (Yn), a sustaining electrode (Xn), and a plurality of address locating electrodes, the driver comprising:

a data driver connecting to the address locating electrode of the plasma display panel, a first scan driver connecting to the scanning electrode of the first group of the scanning lines, a second scan driver connecting to the scanning electrode of the second group of the scanning lines, a first sustaining driver connecting to the sustaining electrode of the first group of the scanning lines, a second sustaining driver connecting to the sustaining electrode of the second group of the scanning lines, and a timing controller for controlling the first scan driver, the second scan driver, the first sustaining driver, and the second sustaining driver to complete the three steps of resetting, scanning, and sustaining in the plasma display panel.

2. A driver of a plasma display panel, wherein the plasma display panel is composed of a plurality of scanning lines configured in a sequence as Ln, Ln+1, Ln+2, Ln+3, Ln+4, Ln+5, Ln+6, Ln+7 . . . , n is an integer, the scanning lines are divided into a first group (Ln, Ln+3, Ln+4, Ln+7 . . . ) and a second group (Ln+1, Ln+2, Ln+5, Ln+6 . . . ), each scanning line (Ln) has a scanning electrode (Yn), a sustaining electrode (Xn), and a plurality of address locating electrodes, the driver comprising:

a data driver connecting to the address locating electrode of the plasma display panel, a first scan driver connecting to the scanning electrode of the first group of the scanning lines, a second scan driver connecting to the scanning electrode of the second group of the scanning lines, a first sustaining driver connecting to the sustaining electrode of the first group of the scanning lines, a second sustaining driver connecting to the sustaining electrode of the second group of the scanning lines, and a timing controller for controlling the first scan driver, the second scan driver, the first sustaining driver, and the second sustaining driver to complete the three steps of resetting, scanning, and sustaining in the plasma display panel.

* * * * *